United States Patent [19]

Schneider, Jr.

[11] Patent Number: 4,741,462

[45] Date of Patent: May 3, 1988

[54] ADJUSTABLE PISTON PACKING EXPANDER FOR CAULKING GUNS

[75] Inventor: Franz K. Schneider, Jr., Moorestown, N.J.

[73] Assignee: Albion Engineering Company, Philadelphia, Pa.

[21] Appl. No.: 316,104

[22] Filed: Oct. 29, 1981

[51] Int. Cl.[4] ..... B67D 5/42

[52] U.S. Cl. ..... 222/386; 222/386.5; 92/202; 92/244; 604/219

[58] Field of Search ..... 222/386, 386.5, 391; 604/219; 92/194, 203, 207, 244, 165 PR, 165 R

[56] References Cited

U.S. PATENT DOCUMENTS

| | | | |
|---|---|---|---|
| 1,003,304 | 9/1911 | Thompson | 92/207 |
| 1,521,890 | 1/1925 | Klein | 604/219 |
| 1,536,477 | 5/1925 | Crewe | 222/391 |
| 1,583,533 | 5/1926 | Deming | 222/386 |
| 1,735,299 | 11/1929 | Rudesyle | 222/391 |
| 2,089,556 | 8/1937 | Jackson | 92/244 |
| 3,537,621 | 11/1970 | Jesse | 222/386 |

FOREIGN PATENT DOCUMENTS

| | | | |
|---|---|---|---|
| 518732 | 2/1931 | Fed. Rep. of Germany | 92/194 |

*Primary Examiner*—Joseph J. Rolla
*Assistant Examiner*—Frederick R. Handren
*Attorney, Agent, or Firm*—Charles F. Duffield

[57] ABSTRACT

An adjustable piston packing expander for use with conventional caulking gun piston assemblies is disclosed. The packing expander threads onto the piston rod and includes a frusto-conical expansion surface which contacts the inner surface of the packing wherein advanced threading of the packing expander onto the piston rod will adjustably expand the packing into sealing engagement with the gun barrel walls. A set screw locks the packing expander in adjustment relative to the packing. A lock washer keyed to the square piston rod and interlocked to a rear piston rod washer having locking pins extending into the packing and forming a part of the piston assembly interlocks the packing against motion relative to the piston rod.

4 Claims, 1 Drawing Sheet

ADJUSTABLE PISTON PACKING EXPANDER FOR CAULKING GUNS

BACKGROUND OF INVENTION

The present invention applies to improvements to caulking guns and, more specifically, to an adjustable piston packing expander for expanding the packing within the piston assembly of the caulking gun.

Industrial quality caulking guns, such as that shown generally at 10 in FIG. 1 of the drawings, utilize a steel barrel 11 into which there is fitted a piston assembly carried by a piston rod 12. The piston assembly, which includes at least one packing, serves to extrude caulking compound through the barrel as the piston rod advances to ultimately extrude the caulking compound through the gun nozzle 13 carried by the front cap 14 generally threaded onto the end of the barrel 11. The piston rod 12 is advanced by means of a hand actuator 15 operating through a well known drive mechanism in the rear of the gun.

Industrial quality guns such as that shown in FIG. 1 of the drawings are filled generally in two different manners. The first is by unscrewing the front cap 14 and engaging the front of the barrel with a bulk container of caulking compound whereupon the piston assembly is retracted rearwardly to draw in a charge of caulking compound from the bulk container. A second and more recently available method of filling the barrel with caulking compound is by the use of what are known as "sausage" packages 16 as shown in FIG. 2. These "sausage" packages are tubelike members formed generally of a thin plastic material such as mylar which is generally in the range of 2 mils thickness. Such packages are filled and are approximately the length of the barrel 11 and are clamped on or tied off at their ends by an appropriate clamp or tie 17.

In use the "sausage" package is inserted into the barrel after the piston is retracted. Thereafter, the end of the package closest the front cap 14 is cut open and the front cap threaded back onto the barrel. The operation of the gun is as in the conventional manner in that the hand actuator 15 drives the piston rod and piston assembly forward compressing and extruding the compound within the package 16 through the nozzle 13 of the gun.

A persistent problem in industrial guns of the nature above described is wear on the piston packing which will permit bypass of the piston by the caulking compound. Additionally, in those situations where the "sausage" type package is used a problem is encountered in that the very thin package, as it is collapsed by the piston assembly, will tend to override or jam between the piston packing and the cylinder walls. As this occurs, the force required to extrude the caulking compound from the gun increases. Additionally, once the caulking compound has been exhausted, difficulty is sometimes encountered in extracting the empty and thin package from the gun barrel.

A need exists in the caulking gun industry and particularly in the industrial grade caulking guns for a means by which the piston packing can be quickly and easily adjusted to accommodate for manufacturing toelrances, wear and other conditions in order to provide for the optimum pressure of the packing against the gun barrel walls. A further need exists for a caulking gun in which the piston packing pressure can be adjusted to provide for use of the gun with lower viscosity materials and which provides for cleaner scavenging and less cleanup.

Maintenance of the optimum pressure will ensure ease of movement of the pistion assembly along the gun barrel walls while, at the same time, preventing caulking compound override of the packing assembly in the case of bulk compound charge in the gun barrel and, in the case of use of the "sausage" packages, prevent interference or bypass of the package and the piston packing.

OBJECTS AND SUMMARY OF INVENTION

It is an object of the present invention to provide an adjustable piston packing expander for use in caulking guns which will fulfill the foregoing needs and provide for quick and easy readjustment of the piston packing expansion pressure against the side walls of the caulking gun barrel.

It is a further object of the present invention to provide an adjustable piston packing expander for use in caulking guns which includes locking means by which, once the piston packing expansion pressure is set, the adjustment may be locked to prevent unintentional loss of adjustment.

The foregoing objects are carried out by the present invention by the utilization of a piston packing expander which includes a frusto-conical expansion face in contact with the piston packing. The packing expander is engaged with the piston rod by thread means in a manner such that rotation of the packing expander upon the piston rod will advance the packing expander longitudinally of the piston rod to expand outwardly the packing as the packing rides upon the frusto-conical expansion face of the packing expander.

A set screw threaded into the end of the packing expander sets against the threaded end of the piston rod to lock the packing expander against further rotational movement relative to the piston rod.

A lock washer is locked against rotation relative to the piston rod and is further secured to a rear piston rod washer forming a part of a piston assembly. The rear piston rod washer includes locking pins forming a part of the piston assembly, extending therefrom which extend through apertures in other associated piston assembly components including the piston packing to interlock the piston assembly against rotational movement relative to the piston rod.

The foregoing two locking devices protect against loss of adjustment once the piston packing expander has been adjusted to optimum pressure upon the packing.

Other objects and advantages of the present invention will become apparent to those skilled in the art from the detailed description thereof which follows taken in conjunction with the drawings.

DETAILED DESCRIPTION OF INVENTION

Figure 1:
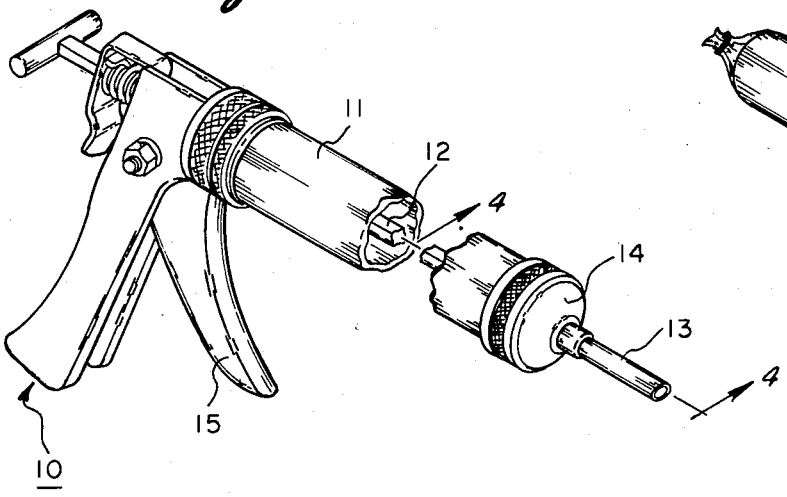
FIG. 1 is a perspective view of an industrial quality caulking gun to which the present invention applies.
Figure 2:
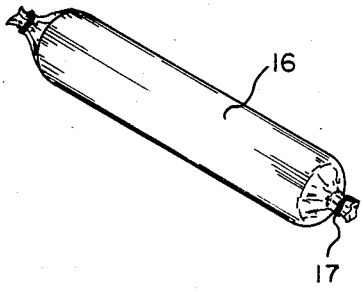
FIG. 2 is a perspective view of a "sausage" package containing caulking compound which may be used in the caulking gun of FIG. 1.
Figure 3:
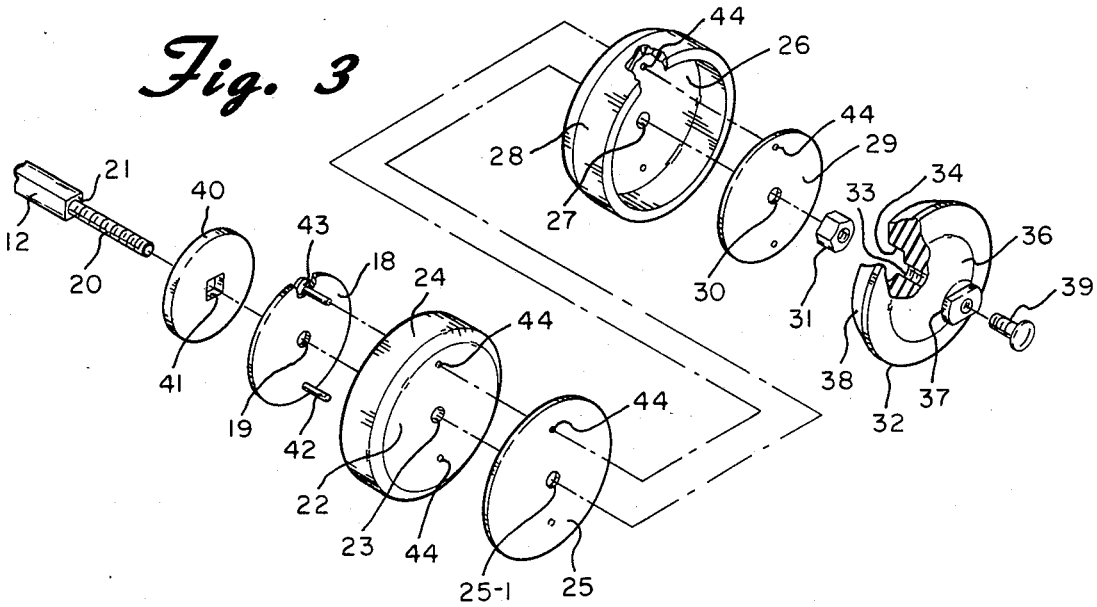
FIG. 3 is an exploded view of the piston rod, piston assembly and piston packing expander of the present invention.
Figure 4:
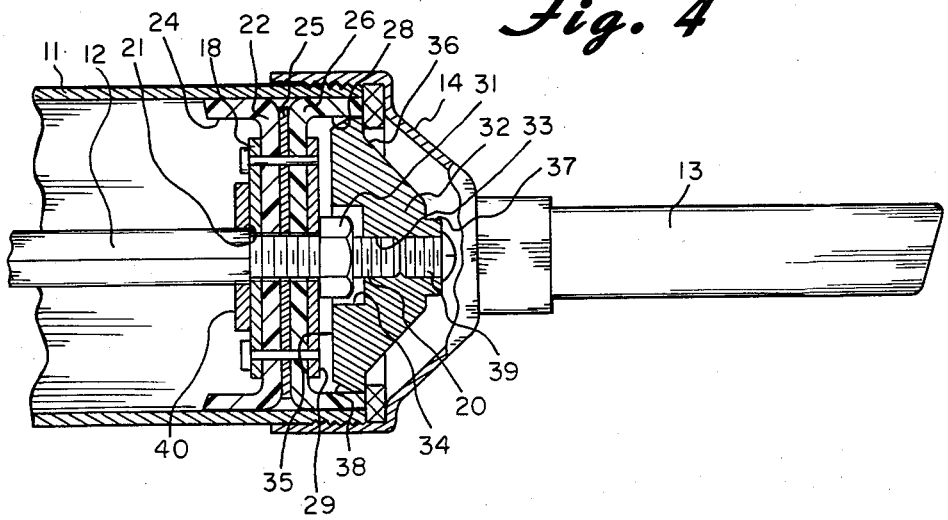
FIG. 4 is a sectional view taken along the lines 4—4 of FIG. 1 illustrating the piston assembly and piston packing expander of the present invention in assembled form.

The piston packing expander of the present invention and the modifications to the standard piston assembly of a conventional industrial quality caulking gun are shown in FIGS. 3 and 4 of the drawings. The following description of the invention will be made jointly in conjunction with FIGS. 3 and 4.

A conventional industrial quality caulking gun includes a gun barrel 11 onto which is threaded a front cap 14 which, in turn, carries the gun nozzle 13. A piston rod 12 of non-circular configuration and shown in FIG. 3 as rectangular or square, extends generally through the center of the barrel 11 and terminates toward the front cap 14.

The piston assembly includes a series of elements, the first of which is a rear piston rod washer 18 which includes an aperture 19 therein which fits over the threaded end 20 of the piston rod 12 and abuts a shoulder 21 on the piston rod 12. A rear packing 22 including an aperture 23 centrally thereof is positioned over the threaded end 20 of the piston rod 12 and engages the rear piston rod washer 18 with the lip 24 of the packing facing rearwardly from the nozzle 13.

Next in the series of elements of the conventional piston assembly is a packing spacer 25 which, likewise, includes a central aperture 25-1 therein for positioning over the threaded end 20 of the piston rod 12. Next following is a front packing 26 having an aperture 27 therein for positioning over the threaded member 20 in a manner such that the lip 28 of the packing faces forwardly toward the nozzle 13.

Further as a part of the piston assembly, a front piston rod washer 29 including a central aperture 30 is positioned upon the threaded member 20 against the front packing 26. Lastly, a nut 31 is threaded upon the threaded end 20 of the piston rod 12 and securely pulled down to maintain the entire assembly in place.

Further forming a part of the piston assembly, the rear piston rod washer 18 includes two locking pins 42. The pins pass through apertures in the rear piston rod washer 18 and extend forwardly toward the remaining elements of the piston assembly. The locking pins 42 are secured within the rear piston rod washer 18 by resistance welding of the head 43 of the locking pin 42 to the face of the rear piston rod washer 18.

The rear packing 22, packing separator 25, front packing 26 and front piston rod washer 29 all include two apertures 44 in alignment with the locking pins 42 and through which the locking pins 42 pass when in assembled relationship. In this manner the rear packing 22 and the front packing 26 and associated washers and separator are all interlocked against rotational movement relative to one another.

In accordance with the present invention, a piston packing expander 32 is provided. The packing expander 32 includes an internally threaded concentric bore 33 which permits the packing expander to be threaded upon the threaded end 20 of the piston rod 12. An internal annular recess 34 in the back face 35 of the piston expander 32 provides for clearance with the nut 31.

The piston packing expander includes a sloping front face 36 which engages the caulking compound either in bulk or in the "sausage" package and acts as the ejector for the caulking gun. The front face 36 includes in the end thereof two parallel flats 37 which permit the use of a wrench to thread the piston expander upon the threaded end 20 of the piston rod 12.

The outer perimeter of the packing expander 32 between the rear face 35 and front face 36 is formed into a frustoconical expansion face 38. The frusto-conical expansion face 38 engages the inner circumference of the packing lip 28 and urges the lip radially outwardly into engagement with the inner circumference of the barrel 11. Rotation of the packing expander 32 in a direction to advance the packing expander toward the front packing 26 will increasingly expand the lip 28 of the packing to increase the packing pressure against the barrel 11. Reverse rotation of the packing expander 32 will, likewise, reduce the packing pressure.

In some models of industrial caulking guns, the handle and piston rod 12 may be rotated relative to the nozzle 13 to provide a difference in angulation between the handle and the nozzle 13 in order to provide clearance for caulking in unaccessible places inasmuch as the end of the nozzle 13 is slanted at an angle and must be maintained in particular reference to the surface being caulked. This rotation of the handle and piston rod 12 tends to permit relative rotation between the piston rod 12 and the packing expander 32 thus varying the adjustment. In accordance with the invention, a set screw 39 is utilized in the threaded aperture 33 of the packing expander 32. Once the packing expander 32 has been adjusted to obtain optimum packing pressure, the lock screw 39 is turned inwardly and engages the threaded end 20 of the piston rod 12 to interlock the piston rod 12 and the packing expander 32 against relative rotation one to the other.

A further safeguard is provided in accordance with the present invention against accidental or unintentional disturbance of the adjustment of the packing expander. A lock washer 40, forming a piston assembly interlocking means, is provided and includes centrally thereof an aperture 41 of configuration complementary to the non-circular portion of the piston rod 12. In this manner the lock washer 40 is interlocked against relative rotational movement with the piston rod 12.

The lock washer 40 is spot welded to the rear piston rod washer 18 forming a part of the piston assembly and thus the piston assembly is interlocked with the piston rod washer 18 against relative rotational movement.

The threaded end 20 of the piston rod 12 preferably utilizes a $\frac{1}{4}\times 28$ thread. When this thread is used, mathematically one revolution of the packing expander 32 will expand radially the lip of the front packing 26 an amount of 0.0126 inches to a side or a total diameter increase of 0.0252 inches. Thus, it may be seen that, in accordance with the present invention, there is provided a piston packing expander which is capable of fine adjustment to maintain optimum packing pressure against the inner circumference of the caulking gun barrel which, inter alia, provides for use of the gun with lower viscosity materials, cleaner scavenge and less cleanup and one which also includes locking means by which the adjustment, once optimized, cannot be inadvertently or accidentally disturbed.

The foregoing invention has been described in respect to a particular embodiment as shown in the drawings and set forth in the specification. Other modifications and variations of the invention will now become apparent to those skilled in the art in view of the foreoing disclosure and therefore, no limitation as to the scope of the invention is intended by the specific embodiment disclosed but the scope of the invention is to be interpreted in view of the appended claims.

What is claimed is:

1. A caulking gun comprising, in combination:

a gun barrel having an inner wall and adapted to receive caulking compound;

an end cap and associated nozzle secured on one end of the gun barrel;

a piston rod extending through the gun barrel and terminating in a first end, a portion of which is of non-circular configuration;

a piston assembly including an expandable packing engaging the inner wall of the gun barrel and carried by the first end of the piston rod;

packing expansion means carried by the first end of the piston rod and adjustably movable relative to the expandable packing to vary the pressure of the packing against the inner wall of the gun barrel; and piston assembly interlocking means secured to the piston assembly and of configuration complementary to the non-circular portion of the piston rod and positioned thereon to interlock the piston rod and piston assembly against relative rotational movement, one to another.

2. The caulking gun of claim 1 wherein the first end of the piston rod is rectangular terminating in a shoulder and a threaded end and wherein the piston assembly interlocking means includes a disk like member having an aperture centrally thereof of configuration complementary to the rectangular portion of the piston rod and adapted to be positioned thereupon and interconnected to the piston assembly.

3. The caulking gun assembly of claim 2 wherein the piston assembly is secured to the end of the piston rod by means of a threaded member upon the threaded end of the piston rod to secure the piston assembly between the shoulder of the piston rod and the threaded member.

4. The caulking gun of claim 3 wherein the packing expansion means includes threads centrally thereof of mating configuration with the threaded end of the piston rod and is threaded upon the piston rod to provide relative longitudinal movement of the packing expansion means relative to the piston rod and wherein the packing expansion means includes a tapered surface engaging the packing and further including locking means to interlock the packing expansion means against relative rotational movement with respect to the piston rod.

* * * * *